US009144130B2

(12) United States Patent
Matthews et al.

(10) Patent No.: US 9,144,130 B2
(45) Date of Patent: Sep. 22, 2015

(54) PORTABLE LIGHTING SYSTEM RESPONSIVE TO SELECTIVE USER ACTUATIONS

(75) Inventors: John W. Matthews, Newport Beach, CA (US); William A. Hunt, Foothill Ranch, CA (US)

(73) Assignee: SureFire, LLC, Fountain Valley, CA (US)

( * ) Notice: Subject to any disclaimer, the term of this patent is extended or adjusted under 35 U.S.C. 154(b) by 326 days.

(21) Appl. No.: 12/686,938

(22) Filed: Jan. 13, 2010

(65) Prior Publication Data

US 2011/0169419 A1 Jul. 14, 2011

(51) Int. Cl.

| | |
|---|---|
| ***H05B 41/34*** | (2006.01) |
| ***H05B 33/08*** | (2006.01) |
| *H05B 37/02* | (2006.01) |

(52) U.S. Cl.

CPC ..... *H05B 33/0842* (2013.01); *H05B 33/0803* (2013.01); *H05B 33/0845* (2013.01); *H05B 37/02* (2013.01)

(58) Field of Classification Search

USPC ..... 315/200 A, 185 S, 312, 291, 307

See application file for complete search history.

(56) References Cited

U.S. PATENT DOCUMENTS

| | | | | |
|---|---|---|---|---|
| 5,430,356 | A * | 7/1995 | Ference et al. | 315/291 |
| 6,566,819 | B2 * | 5/2003 | Wolff | 315/149 |
| 6,623,273 | B2 * | 9/2003 | Evangelisti | 434/185 |
| 7,852,234 | B1 * | 12/2010 | Borenstein et al. | 340/925 |
| 8,148,912 | B2 * | 4/2012 | Kim | 315/291 |
| 8,646,938 | B1 * | 2/2014 | Sunshine | 362/184 |
| 2005/0062442 | A1 * | 3/2005 | Lu | 315/291 |
| 2005/0111231 | A1 * | 5/2005 | Crodian et al. | 362/545 |
| 2006/0273741 | A1 * | 12/2006 | Stalker, III | 315/291 |
| 2010/0084997 | A1 * | 4/2010 | Oberzeir et al. | 315/313 |
| 2010/0117539 | A1 * | 5/2010 | Kotani et al. | 315/90 |
| 2010/0176744 | A1 * | 7/2010 | Lee et al. | 315/294 |
| 2010/0219775 | A1 * | 9/2010 | Maglica et al. | 315/362 |
| 2010/0327747 | A1 * | 12/2010 | Harris | 315/77 |
| 2011/0095703 | A1 * | 4/2011 | Wilson et al. | 315/294 |
| 2012/0098432 | A1 * | 4/2012 | Recker et al. | 315/86 |

OTHER PUBLICATIONS

Fenix L2D, Fenix Flashlight, http://www.fenixlight.com/flashlight/fenix12d.htm, Sep. 29, 2008, 4 pages.

* cited by examiner

*Primary Examiner* — Tuyet Vo

(74) *Attorney, Agent, or Firm* — Haynes and Boone, LLP

(57) ABSTRACT

Various techniques are provided to facilitate the indication of visual signals, such as SOS signals, strobe signals, and/or types of signals using a portable lighting system. The system may be implemented as a flashlight, a headlamp, or other type of lighting system. The system may be operated using a push-button switch, a rotatable potentiometer, or other appropriate types of user control interfaces. In one example, the system includes a light source adapted to emit light. The system also includes a user control interface adapted to receive user input and generate one or more control signals based on the user input. The system further includes a control circuit adapted to receive the one or more control signals from the user control interface, determine a function sequence based on a pattern provided by the one or more control signals, and cause the light source to operate in accordance with the function sequence.

30 Claims, 5 Drawing Sheets

PORTABLE LIGHTING SYSTEM RESPONSIVE TO SELECTIVE USER ACTUATIONS

BACKGROUND

1. Technical Field

The present invention generally relates to portable lighting systems and, in particular, to facilitating the indication of various signals with a portable lighting system.

2. Related Art

Portable lighting systems such as flashlights are often used for a wide variety of applications. For example, a portable lighting system may be used to provide ambient illumination as well as various types of visual signals. For example, a conventional flashlight or headlamp may include user controls to power up and power down one or more light sources and to select various modes of operation (e.g., varying degrees of illumination, different colors, or various visual signals). To select these different modes of operation, multiple switches or multi-position switches may be used. However, these existing systems are often confusing and difficult to operate such that a user may erroneously select an incorrect lighting mode, which can be inconvenient and even dangerous when the light is being used in military or law enforcement settings. As such, there currently exists a need for an improved approach to the selection of modes of operation for portable lighting systems.

SUMMARY

Systems and methods disclosed herein, in accordance with one or more embodiments of the present disclosure, facilitate the selection of various modes of operation in portable lighting systems such as flashlights, headlamps, etc., including visual distress signals, strobe functions, and/or other signals. In various embodiments, the portable lighting system may be operated using a push-button switch, a rotatable potentiometer, or other appropriate types of user control interfaces.

In one embodiment, a portable lighting system includes a light source adapted to emit light; a user control interface adapted to receive user input and generate one or more control signals based on the user input; and a control circuit adapted to receive the one or more control signals from the user control interface, determine a function sequence based on a pattern provided by the one or more control signals, and cause the light source to operate in accordance with the function sequence.

In another embodiment, a method of initiating a visual signal with a portable lighting system includes monitoring user input via a user control interface of the portable lighting system; receiving one or more control signals based on the user input via the user control interface; determining whether a function sequence is initiated based on a pattern provided by the one or more control signals; and operating a light source of the portable lighting system in accordance with the function sequence.

In another embodiment, a portable lighting system includes means for emitting light; means for receiving user input; means for receiving one or more control signals based on the user input; means for determining whether a function sequence is initiated based on a pattern provided by the one or more control signals; and means for operating the light emitting means in accordance with the function sequence.

In another embodiment, a machine-readable medium includes a plurality of machine-readable instructions which when executed by a computing device of a portable lighting system are adapted to cause the computing device to monitor one or more control signals corresponding to user input received via a user control interface; determine whether a function sequence is initiated based on a pattern provided by the one or more control signals; and operate a light source of the portable lighting system in accordance with the function sequence.

These and other features and advantages of the present disclosure will be more readily apparent from the detailed description of the embodiments set forth below taken in conjunction with the accompanying drawings.

Figure 1A:
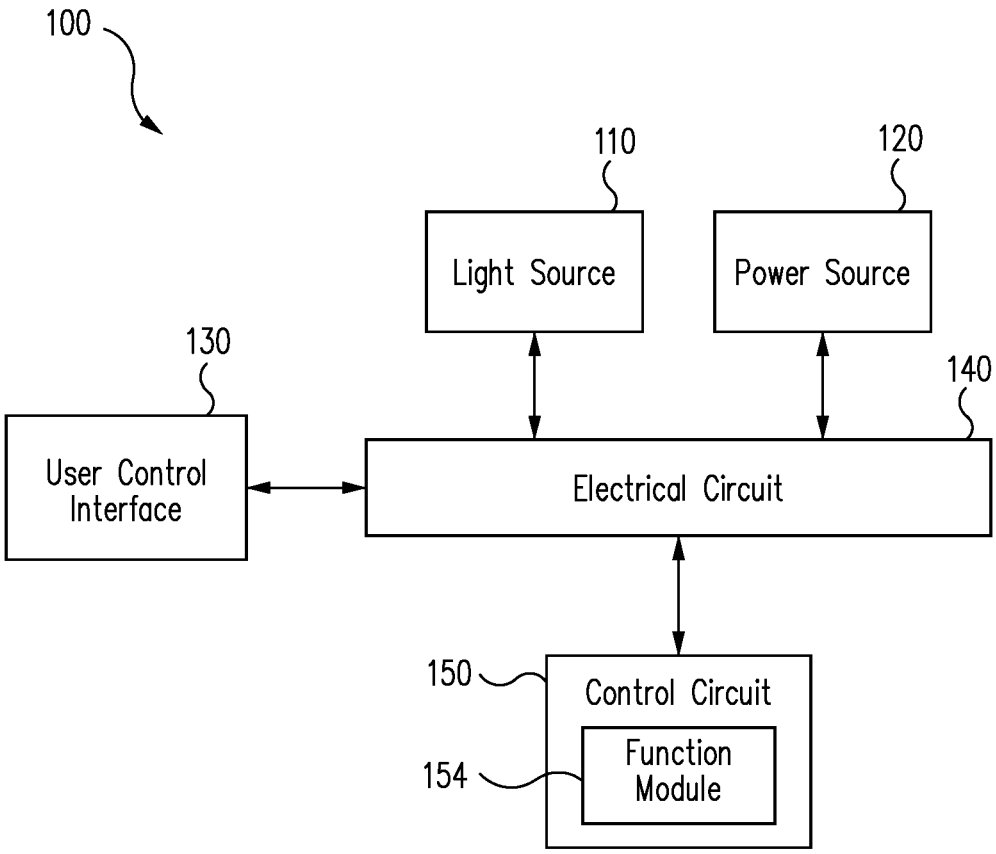
FIG. 1A shows a block diagram of a portable lighting system adapted to facilitate distress signal indication, in accordance with an embodiment of the present disclosure.

Embodiments of the present disclosure and their advantages are best understood by referring to the detailed description that follows. It should be appreciated that like reference numerals are used to identify like elements illustrated in one or more of the figures, wherein showings therein are for purposes of illustrating embodiments of the present disclosure and not for purposes of limiting the same.

DETAILED DESCRIPTION

Systems and methods disclosed herein, in accordance with one or more embodiments of the present disclosure, facilitate the selection of various modes of operation in portable lighting systems such as flashlights, headlamps, etc., including visual distress signals, strobe functions, and/or other signals. In one embodiment, the portable lighting system comprises a flashlight adapted to visually display a distress signal and/or various other types of visual signals. In another embodiment, the portable lighting system comprises a headlamp adapted to visually display such signals.

FIG. 1A shows one embodiment of a block diagram of a portable lighting system 100 adapted to facilitate the indication of various visual signals including distress signals (e.g., an SOS signal and/or a strobe signal). As shown in FIG. 1A, the portable lighting system 100 includes a light source 110, a power source 120, a user control interface 130, an electrical circuit 140, and a control circuit 150. In one implementation, referring to FIG. 1B, the portable lighting system 100 comprises a flashlight 102 having a cylindrical body 160, a head cap 170, and an end cap 180. In another implementation, referring to FIG. 1C, the portable lighting system 100 comprises a headlamp 104 that may be secured to a harness 162 for positioning on a user's head.

Figure 1B:
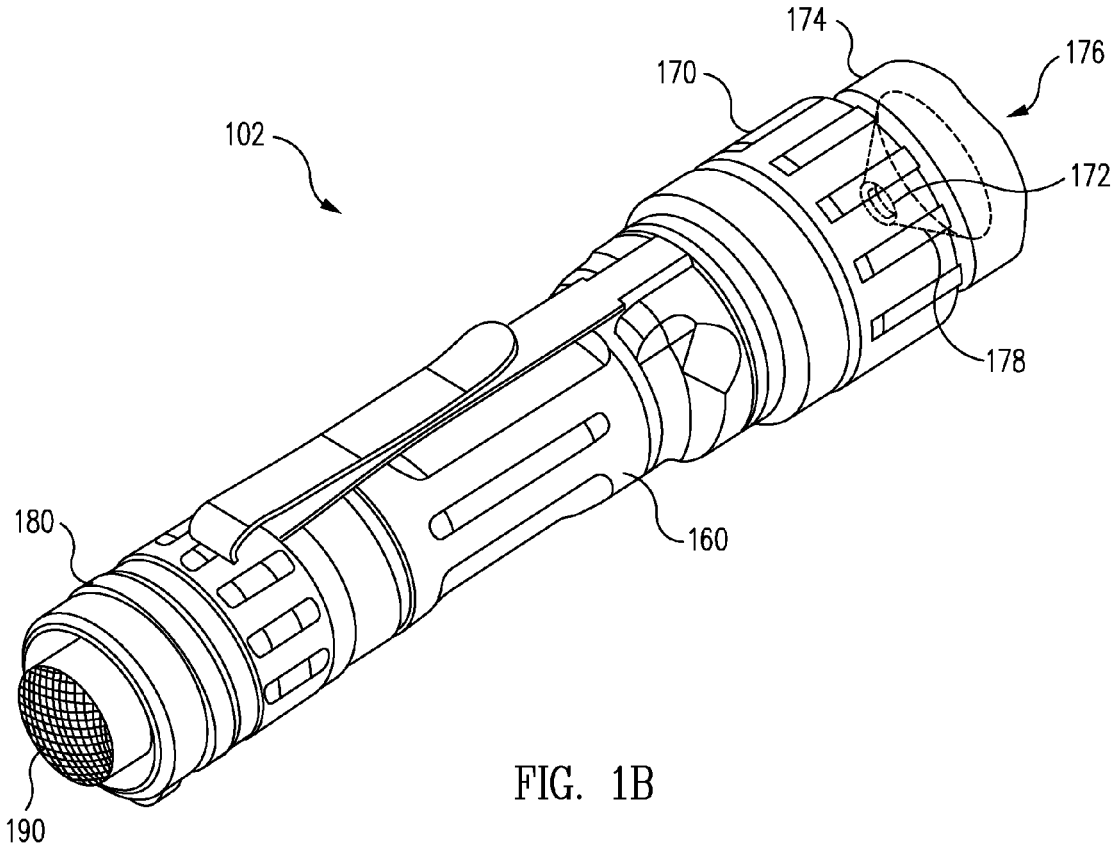
FIG. 1B shows a perspective view of a flashlight, in accordance with an embodiment of the present disclosure.

Referring to FIGS. 1A and 1B, the light source 110, in one embodiment, is adapted to be positioned in the head cap 170 and comprises at least one light emitting diode (LED) 172, such as at least one 3 Watt Cree LED. It should be appreciated that various other types of light sources, such as light bulbs and/or light emitting sources including multiple LEDs, may be used without departing from the scope of the present disclosure. In one implementation, the head cap 170 may comprise a removable assembly having one or more LEDs 172 positioned in a housing 174 with a transparent cover 176 and a conical reflector 178 to direct light or a beam of light as output from the flashlight 102.

Referring to FIGS. 1A and 1B, the power source 120, in one embodiment, comprises a battery source of about 3V (volts). In various implementations, the battery source may be adapted to provide various power source voltages depending on power considerations without departing from the scope of the present disclosure. The light source 110 (e.g., LED 172) is powered by the power source 120, which may comprise one or more 3V Lithium cells in parallel or 2 AA batteries in series. The light output is adapted to be continuously adjustable and may be in a range, for example, of approximately 80 to 100 Lumens.

Referring to FIGS. 1A and 1B, the user control interface 130, in one embodiment, comprises a user actuated control mechanism 190, such as a push-button switch (e.g., depressible end cap). In one implementation, light output of the light source 110 is adapted to be controlled based on user actuation of the user control interface 130 (e.g., user depression of the push-button switch or end cap). In one implementation, as shown in FIG. 1B, the user actuated control mechanism 190 is coupled to the end cap 180 and is adapted to be user actuated by pressing the end cap 180 (e.g., a push button end cap or tail cap switch).

Figure 1C:
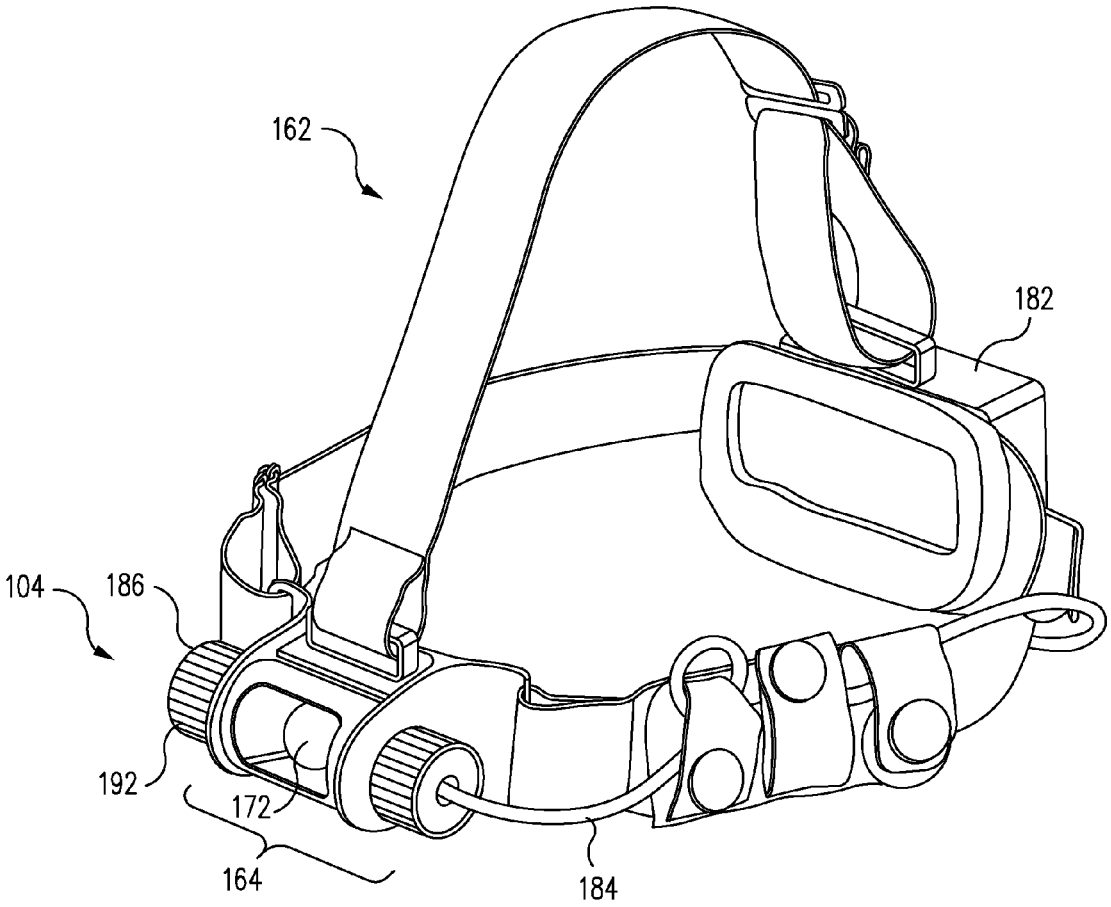
FIG. 1C shows a perspective view of a headlamp, in accordance with an embodiment of the present disclosure.

In another embodiment, referring to FIGS. 1A and 1C, the headlamp 104 is adapted to be secured to the harness 162 for positioning on a user's head. The headlamp 104 comprises the light source 110, such as the one or more LEDs 172 of FIG. 1B. The power source 120 comprises a battery pack 182 coupled to the harness 162. Wires 184 connect power source 120 to the headlamp 104. The user control interface 130 comprises a user actuated control mechanism 192, such as a variable resistor (e.g., a rotary switch or knob). In one example, the user control interface 130 of FIG. 1A (i.e., user actuated control mechanism 192 of FIG. 1C) comprises a user actuated variable resistor, such as a potentiometer (POT), wherein light output of the light source 110 is adapted to be controlled based on user rotation of the POT. As shown in FIG. 1C, the user control mechanism 190 may be coupled to an end cap 186 of the headlamp 104 and is adapted to be user actuated via rotation of the end cap 186 (e.g., rotary switch or POT).

In still another embodiment, it should be appreciated that the rotary switch or knob 192 of FIG. 1C may be integrated into the end cap 180 of the flashlight 102 of FIG. 1B, without departing from the scope of the present disclosure. In yet another embodiment, it should be appreciated that the push-button switch (e.g., depressible end cap) 190 of FIG. 1B may be integrated into the end cap 186 of the headlamp 104 of FIG. 1C, without departing from the scope of the present disclosure.

Referring to FIGS. 1A, 1B, and 1C, the electrical circuit 140, in one embodiment, comprises an electrical connection mechanism for electrically interconnecting components of the portable lighting system including the light source 110 (e.g., one or more LEDs 172), the power source 120 (e.g., battery), the user control interface 130 (e.g., push-button switch 190 of FIG. 1B or POT 192 of FIG. 1C), and the control circuit 150. In various implementations, the electrical circuit 140 comprises hard-wired electrical circuitry.

The control circuit 150, in one embodiment, comprises one or more circuit elements including analog and/or logic based circuitry. In various implementations, analog based logic circuitry comprising various circuit elements (e.g., resistors, capacitors, etc.) may be used to implement the various control aspects of the present disclosure. In various other implementations, digital based logic circuitry may be used to implement the various control aspects of the present disclosure.

For example, the control circuit 150 may include microcontroller based circuitry having a processing component (e.g., CPU), system memory (e.g., RAM), static storage (e.g., ROM), serial communication capability, and input/output (IO) interface capability. The control circuit 150 includes a function module 154 comprising, for example, a processor, microcontroller, or other type of computing device. Function module 154 also comprises a program or application having a sequence of instructions (e.g., software) executable by a computing device, wherein the light output of the light source 110 is adapted to be regulated by software based runtime parameters, as described herein. In one aspect, the CPU may begin execution of the program once the power source 120 (e.g., battery) is installed.

In various implementations, the execution of instruction sequences (e.g., function module 154) to practice the present disclosure may be performed by a microcontroller. As such, the microcontroller may be adapted to perform specific operations by executing one or more sequences of one or more instructions stored in system memory. Such instructions may be read into system memory from another computer readable medium, such as static storage, e.g., ROM. In other embodiments, hard-wired logic circuitry may be used in place of or in combination with software instructions to implement the present disclosure.

In one implementation, the microcontroller may be adapted to transmit and receive messages, data and information including instructions, such as one or more programs (i.e., application code) through, for example, a serial communication link (e.g., the microcontroller may be adapted to support a half duplex serial communication protocol). Received program code may be executed by the processing component as received and/or stored in system memory (e.g., RAM) or static storage (e.g., ROM) for execution.

Logic may be encoded in a computer readable medium, which refers to any medium that participates in providing instructions to the processing component for execution. Such a medium may take many forms, including but not limited to, non-volatile media, volatile media, and transmission media. Some common forms of computer readable media include, for example, various types of magnetic medium including RAM, PROM, EPROM, FLASH-EPROM, any other memory chip, carrier wave, or any other medium from which a computer is adapted to read.

In various implementations, the control circuit 150 may include one or more various other types of hardware components. For example, the CPU may be provided with a clean hardware reset from a TPS3801 voltage supervisor available from Texas Instruments, Inc. of Dallas, Tex. The control circuit 150 may include a boost controller that is adapted to be driven by a pulse width modulated (PWM) waveform to boost the voltage to drive the LED. In one aspect, PWM is adapted to digitally generate a constant DC voltage by pulsing a high frequency signal. The control circuit 150 may include one or more ADC (i.e., analog-to-digital converter) components, such as a potentiometer analog-to-digital converter (POT ADC) and/or a power source sampler.

The battery voltage may be sampled by the CPU without a voltage divider, wherein if a voltage threshold is exceeded a current limiting algorithm may be implemented. The limiting algorithm may be adapted to modify the POT ADC value. An LM4041 chip may be used to provide a 1.225 V reference source, wherein ADC conversions may be expressed as a ratio of the reference voltage. The control circuit 150 may include a PWM peripheral component that may be utilized to generate a duty cycle adapted to correlate with the potentiometer. To monitor temperature, a thermistor (e.g., within control circuit 150) may be utilized to inhibit the control circuit 150 from overheating, wherein if a temperature threshold is exceeded, then the current limiting algorithm may be implemented.

In one embodiment, as previously described in reference to FIGS. 1A and 1B, the user control interface 130 comprises a user actuated control mechanism 190, such as a push-button switch, wherein light output of the light source 110 (e.g., one or more LEDs 172) is adapted to be variably adjusted based on user actuation or depression of the push-button switch 190. As shown in FIG. 1B, the user actuated push-button switch 190 is coupled to the end cap 180 so as to be user actuated via depression of the switch 190 into the end cap 180.

In this regard, the light output of the LED 172 may be controlled by the control circuit 150 in response to a depression of the push-button switch 190. For example, the push-button switch 190 may be cycled through one or more depressions to control the brightness of the light output of the LED 172. As another example, the push-button switch 190 may be depressed in a pattern to select one or more lighting modes of operation, such as displaying visual signals including SOS and strobe.

In another embodiment, as previously described in reference to FIGS. 1A and 1C, the user control interface 130 comprises a user actuated control mechanism 192, such as a rotary switch or rotatable potentiometer (POT), wherein light output of the light source 110 (e.g., LED 172) is adapted to be variably adjusted based on user actuation or rotation of the POT 192. As shown in FIG. 1C, the user actuated POT 192 is coupled to the end cap 186 so as to be user actuated via rotation of the POT 192 about the end cap 186.

In various implementations, referring to FIG. 1C, the light output of the LED 172 is controlled by the control circuit 150 with an approximately 270° swing of the POT 192. The LED 172 may be considered off when the POT 192 is turned in a full counter-clockwise position, which may be referred to as a low power mode such that the LED 172 is adapted to draw a low current or no current. For example, a target low current draw may be less than approximately 50 uA. The POT 192, when operating in conjunction with the control circuit 150, may be adapted to allow for a 100 to 1 dynamic range. The 270° swing of the POT 192 may range from 0 to 1023 counts or be divided in as many intervals. In one aspect, zero (i.e., 0) may comprise a minimum POT threshold and refers to the off position. The resolution of the POT 192 may be altered, e.g., the resolution of the POT 192 may be divided in half to achieve 0 to 511 counts.

In one aspect, the value of the POT 192 (i.e., also referred to as a pot value) may be influenced by at least two parameters, such as temperature, battery voltage, and/or other parameters. A modified pot value may be calculated for each of the parameters based on exceeding their respective limiting thresholds. For example, an ultimate pot value arrived at may be the smaller of the actual pot value or of the two limited calculated pot values. In other words, regardless of the rotation of the POT 192, the pot value received by the control circuit 150 may be "the smallest pot value."

In another aspect, once the POT 192 exceeds the minimum pot threshold, the control circuit 150 turns the LED 172 on and the LED 172 stays on (e.g., LED 172 may be turned on from a previous off state or sleep state). The control circuit 150 continuously converts user control signals from the POT 192 and calculates PWM values based on the rotation of the POT 192. In some instances, the PWM values may include factoring in parameters that may control the LED output.

In one implementation, the POT 192 may be powered by the control circuit 150 comprising, for example, a microcontroller and CPU, which is adapted to sense voltage drops across an internal field effect transistor (FET). It should be appreciated that various other types of circuitry may be used to achieve similar results.

Figure 2:
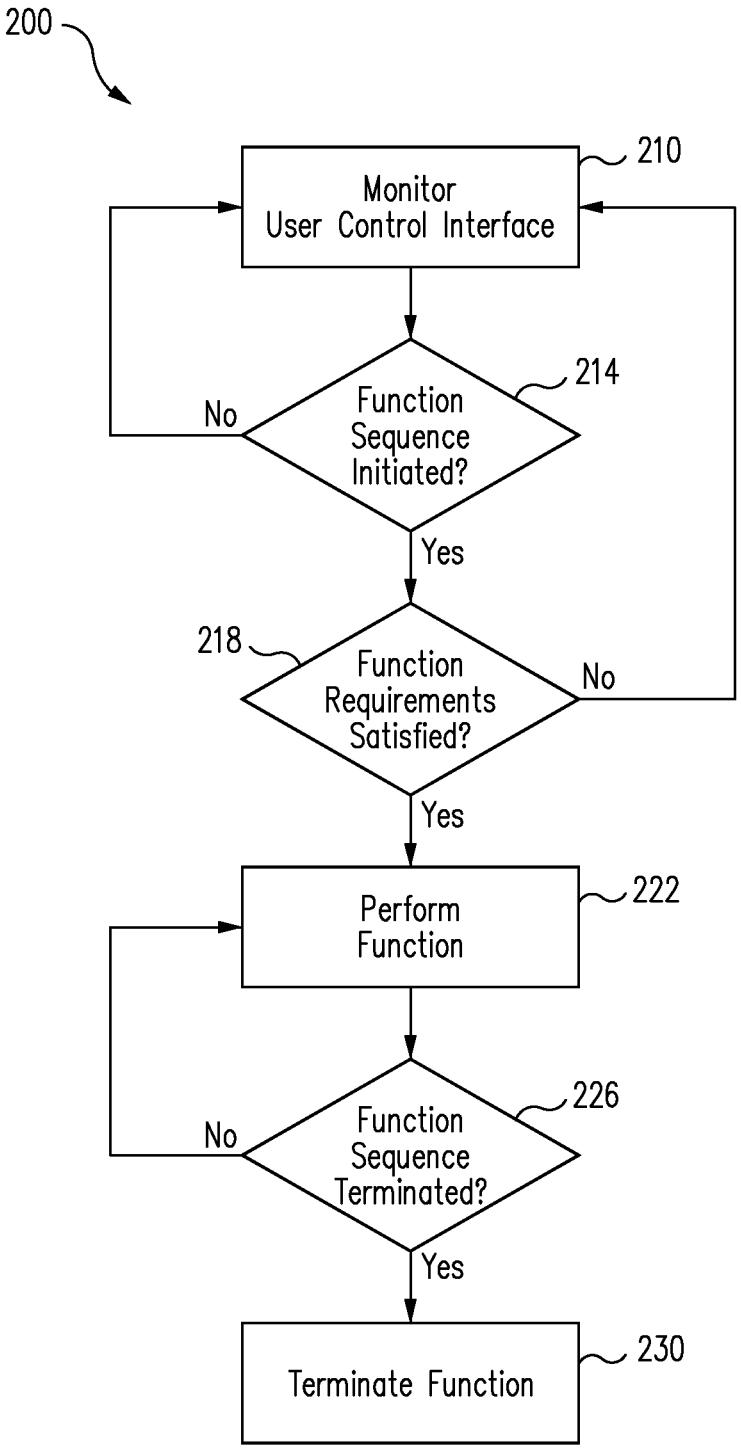
FIG. 2 shows a method for facilitating the indication of distress signals with a portable lighting system, in accordance with an embodiment of the present disclosure.

FIG. 2 shows one embodiment of a method 200 for facilitating the indication of visual signals (e.g., distress signals) with the portable lighting system 100 of FIG. 1. The control circuit 150 is adapted to monitor the user control interface 130 (block 210). For example, the control circuit 150 is adapted to receive a control signal from the user control interface 130, such as the push-button switch 190 of FIG. 1B or the POT 192 of FIG. 1C. In one aspect, as previously described, the LED 172 is variably adjustable based on user depression of the push-button switch 190 of FIG. 1B or user rotation of the POT 192 of FIG. 1C, wherein the intensity of light output of the LED 172 is selected by a pattern of depression of the push-button switch 190 of FIG. 1B or by variably adjusting the position of the POT 192 within the range of rotation. In another aspect, one or more other lighting modes of operation may be selected based on user input via the push-button switch 190 of FIG. 1B or the POT 192 of FIG. 1C, as described herein.

Next, the control circuit 150 is adapted to determine if a function sequence is initiated based on user input via the user control interface 130 (block 214). If no, then the control circuit 150 continues to monitor the user control interface 130 (block 210). Otherwise, if yes, then the method 200 proceeds to the next operation (block 218). In one implementation, a user actuated function sequence may include a pattern or series of depressions of the push-button switch 190 of FIG. 1B or rotational movements of the POT 192 of FIG. 1C within a predetermined period of time. Such patterns may be provided from the user control interface 130 to control circuit 150 through one or more control signals. In one example, referring to FIG. 1B, a pattern of depressions with the push-button switch 190 may be counted and interpreted as a user initiated function (e.g., by counting one or more control signals received by the control circuit 150 corresponding to the pattern of depressions). In another example, referring to FIG. 1C, a pattern of on and off rotational movements with the POT 192 may be counted and interpreted as a user initiated function (e.g., by counting one or more control signals received by the control circuit 150 corresponding to the pattern of rotational movements). Further scope related to this user actuated function sequence is described herein.

Next, the control circuit 150 is adapted to determine if one or more function requirements are satisfied based on the received function sequence (block 218). If no, then the control circuit 150 proceeds to continue monitoring the user control interface 130 (block 210). Otherwise, if yes, then the method 200 proceeds to the next operation (block 222).

In one implementation, referring to FIG. 1B, if the user actuated function sequence includes a pattern of depressions with the push-button switch 190 within a predetermined period of time, then a predetermined function may be performed. For example, a pattern of three, quick depressions with the push-button switch 190 may be counted and stored as a user initiated function, wherein the function requested by the user may include performing a visual distress signal with the LED 172. Further scope related to this user actuated function sequence is described herein.

In another implementation, referring to FIG. 1C, if the user actuated function sequence includes a series of rotational movements with the POT 192 within a predetermined period of time, then a predetermined function may be performed. For example, a series of three, quick on and off rotational movements with the POT 192 may be counted and stored as a user initiated function, wherein the function requested by the user may include performing a visual distress signal with the LED 172. Further scope related to this user actuated function sequence is described herein.

Next, the control circuit 150 is adapted to cause the portable lighting system 100 to perform a function (e.g., by sending appropriate signals to the electrical circuit 140 to operate the light source 110) as determined by interpretation of the function sequence (block 222). In one implementation, referring to FIG. 1B, if the user actuated function sequence comprises a pattern of three, quick depressions with the push-button switch 190, then the control circuit 150 is adapted to perform a visual distress signal with the LED 172. In another implementation, referring to FIG. 1C, if the user actuated function sequence comprises a series of three, quick on and off rotational movements with the POT 192, then the control circuit 150 is adapted to perform a visual distress signal with the LED 172. In various examples, performing the visual distress signal comprises displaying the internationally recognized SOS signal or, alternately, various other signals, such as a strobe signal. Further scope related to performing the visual distress signal with the LED 172 is described herein.

Next, the control circuit 150 is adapted to determine if the function sequence is terminated based on user input via the user control interface 130 (block 226). For example, the control circuit 150 may be adapted to cause the portable lighting system 100 to stop performing the function of block 222 by sending one or more appropriate signals to the electrical circuit 140. If the function sequence is not terminated, then the control circuit 150 is adapted to continue performing the function (block 222). Otherwise, if the function sequence is terminated, then the control circuit 150 is adapted to terminate the function based on user input via the user control interface 130 (block 230).

In various embodiments, referring to FIG. 2, the function sequence initiated by a user via the user interface device 130 (e.g., the push-button switch 190 of FIG. 1B or the POT 192 of FIG. 1C) may comprise a type of repetitive pattern, such as the following repetitive SOS entry sequence for an SOS mode of operation, which may be defined by a pattern of three 'ON' and 'OFF' cycles (also referred to as power up and power down cycles, respectively) as follows:

Cycle 1: turn POT ON for <500 ms to 1000 ms, and turn POT OFF for <500 ms;

Cycle 2: turn POT ON for <500 ms to 1000 ms, and turn POT OFF for <500 ms; and

Cycle 3: turn POT ON for <500 ms to 1000 ms.

These cycles may also be applied to the push-button switch 190 of FIG. 1B, by depressing the push-button switch 190 in a pattern with similar timing.

In various implementations, a timeout may reset the counter, and the sequence may have to be restarted. During performance of the SOS mode of operation, the POT 192 of FIG. 1C remains functional to user input. The control circuit 150 may continue to perform the SOS mode of operation until turned off via user input (e.g., by turning POT 192 to the off position). Once turned off, the SOS entry sequence may have to be performed to enable or re-enable the SOS mode of operation. In various other implementations, it should be appreciated that any type of repetitive pattern may be utilized to determine various functions (e.g., SOS, strobe, or various other repeating functions) and function sequences without departing from the scope of the present disclosure. These repetitive patterns may also be applied to the push-button switch 190 of FIG. 1B.

In various implementations, one or more switch rates (i.e., the rate of user actuation or switching of the user control interface 130) may be utilized to initiate one or more modes of operation. For example, a default (e.g., very slow) switch rate may be utilized to turn the light source 110 on and/or off; a slow switch rate may be utilized to adjust the brightness of the light source 110 to either brighter or less bright; a fast switch rate may be utilized to trigger the strobe and/or SOS modes of operation, as discussed herein in one or more embodiments; and a very fast switch rate may be utilized to sense a bounce contact (e.g., a false on and/or off), such as dropping the portable lighting system 100 on the ground or an inadvertent actuation or switching. Accordingly, the control circuit 150 (e.g., processing component) may be adapted to discern between these different switch rates for proper operation of the portable lighting system 100. These switch rates may also be applied to the push-button switch 190 of FIG. 1B.

Figure 3:
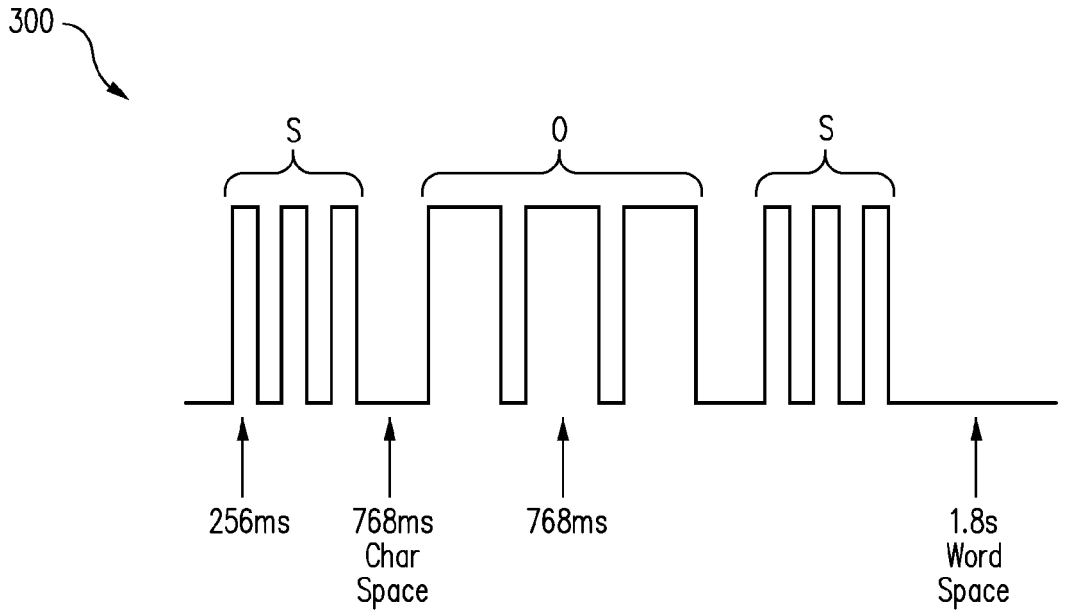
FIG. 3 shows a visual distress signal implemented with a portable lighting system, in accordance with an embodiment of the present disclosure.

FIG. 3 shows one embodiment of implementing a visual SOS signal with the light source 110 (e.g., LED 172) of the portable lighting system 100. As shown in FIG. 3, a timing of the SOS signal comprises pulsing voltage to the LED 172 as a square wave with varying timing periods.

In one implementation, the control circuit 150 is adapted to implement the visual SOS signal as a plurality of symbols, such as "•••---•••". The symbol "•" may be referred to as a "di", and the symbol "-" may be referred to as a "dah". In various aspects, as shown in FIG. 3, the "di" refers to 1 unit of time (e.g., 256 ms), and the "dah" refers to 3 units of time (e.g., 768 ms), In various other aspects, referring to FIG. 3, the time period between either the "di" or the "dah" refers to 1 unit of time (e.g., 256 ms), the time period between characters (i.e., S or O or S) comprises 3 units of time (e.g., 768 ms), and the time period between words (i.e., SOS) comprises 7 units of time (e.g., about 1.8 ms).

Figure 4:
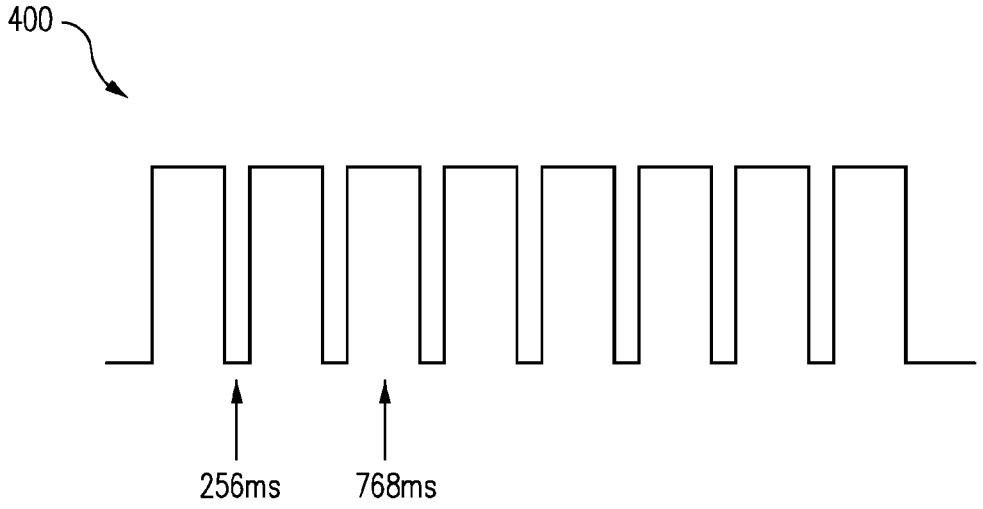
FIG. 4 shows a visual strobe signal implemented with a portable lighting system, in accordance with an embodiment of the present disclosure.

FIG. 4 shows one embodiment of implementing a visual strobe signal with the light source 110 (e.g., LED 172) of the portable lighting system 100 that may be implemented as a strobe signal based on user input selection via the user control interface 130. As shown in FIG. 4, a timing of the strobe signal comprises pulsing voltage to the LED 172 as a sequence of square wave pulses having a similar timing period.

In one implementation, the control circuit 150 is adapted to implement the visual strobe signal as a sequence of the same symbol, such as "------". In one aspect, the symbol "-" may be similarly referred to as a "dah" from the SOS example of FIG. 3. As shown in FIG. 4, the "dah" may refer to 3 units of time (e.g., 768 ms), and the time period between the "dah" may refer to 1 unit of time (e.g., 256 ms). In various other examples, it should be appreciated that the timing periods of the strobe pulses and the timing periods between the strobe pulses may comprise any desirable length of time to achieve a strobe function without departing from the present disclosure.

In various implementations, the strobe function may be selected by user input via the user control interface 130 (e.g., the push-button switch 190 of FIG. 1B or the POT 192 of FIG. 1C). Accordingly, a strobe function sequence initiated by a user via the user interface device 130 may comprise a type of repetitive pattern, such as a repetitive strobe entry sequence for a strobe mode of operation, which may be defined by two or more 'ON' and 'OFF' cycles. In various examples, the strobe function may be selected with a repetitive pattern of two 'ON' and 'OFF' cycles to initiate the strobe mode of operation, and the SOS function may be selected with a repetitive pattern of three 'ON' and 'OFF' cycles to initiate the SOS mode of operation.

In various implementations, as previously described, the control circuit 150 comprises a microcontroller having a CPU adapted to execute software code. The function module 154 comprises the executable function code for implementing the SOS entry sequence and performing the visual SOS signal. The function module 154 may be further adapted to conserve battery power of the power source 120 while being responsive to the user control interface 130 (e.g., the push-button switch 190 of FIG. 1B or the POT 192 of FIG. 1C), monitor runtime parameters, and regulate light output of the light source 110 (e.g., LED 172) accordingly. The function module 154 may be adapted to initialize and perform processing in a continuous loop, which may comprise sleeping for a predetermined period of time (e.g., 64 mS) and then sampling the user control interface 130 (e.g., the push-button switch 190 of FIG. 1B or the POT 192 of FIG. 1C). Once the POT 192 exceeds a minimum threshold count, the control circuit 150 may be considered turned on and runtime operation of the function module 154 may begin. During runtime operation, execution of the function module 154 may not sleep. In one aspect, operation parameters, such as battery voltage, reference voltage, temperature, and POT voltage, may be continuously monitored, and the light output may be regulated based on the monitored parameter values. In many instances, the light output of the light source 110 (e.g., LED 172) may be preferably controlled by the push-button switch 190 of FIG. 1B or the POT 192 of FIG. 1C. However, temperature and/or battery voltage affect the light output, as previously described herein.

Embodiments of the present disclosure presented herein may be used to provide various features when implemented in a portable lighting system. For example, multiple functions may be performed using a single user control interface. In this regard, the user control interface 130 may be used to turn the portable lighting system 100 on and off. Advantageously, the same user control interface 130 may also be used to cause the portable lighting system 100 to enter other modes of operation (e.g., strobe and or SOS modes of operation).

Also, strobe and/or SOS triggering may be performed in a manner that matches a user's intuitive expectation of how the portable lighting system 100 operates. For example, in one embodiment, strobe or SOS modes of operation may be triggered by a user interaction with the user control interface 130 in a manner that mimics strobe or SOS signal patterns. As a result, such the portable lighting system 100 can operate in a manner that is predictable to a user in emergency conditions or otherwise.

Where applicable, various embodiments provided by the present disclosure may be implemented using hardware, software, or combinations of hardware and software. Also, where applicable, the various hardware components and/or software components set forth herein may be combined into composite components comprising software, hardware, and/or both without departing from the spirit of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components and vice-versa.

Software, in accordance with the present disclosure, such as program code and/or data, may be stored on one or more computer readable mediums. It is also contemplated that software identified herein may be implemented using one or more general purpose or specific purpose computers and/or computer systems, networked and/or otherwise. Where applicable, the ordering of various steps described herein may be changed, combined into composite steps, and/or separated into sub-steps to provide features described herein.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A portable lighting system comprising:

a light source adapted to provide both ambient illumination and visual signals;

a user control interface comprising a single user actuated control mechanism adapted to receive a pattern of a plurality of selective actuations by a user within a predetermined period of time and while the portable lighting system is held by the user for portable use, wherein the pattern comprises one or more switch rates; and a control circuit adapted to receive the pattern from the user control interface and execute a sequence of instructions to:

determine the one or more switch rates of the received pattern, determine a function sequence based, at least in part, on the one or more switch rates of the received pattern after the predetermined period of time has timed out, and cause the light source to display a repeating visual signal associated with the function sequence.

2. The system of claim 1, wherein the light source comprises at least one light emitting diode (LED).

3. The system of claim 1, wherein the function sequence is an SOS signal.

4. The system of claim 1, wherein the function sequence is a strobe signal.

5. The system of claim 1, wherein the system is a flashlight configured to be held for portable use by a hand of the user.

6. The system of claim 1, wherein the system is a headlamp configured to be held for portable use by a head of the user.

7. The system of claim 1, wherein the single user actuated control mechanism comprises a push-button switch, and wherein the pattern corresponds to a pattern of depressions of the push-button switch within the predetermined period of time.

8. The system of claim 7, wherein the control circuit is adapted to count a number of the depressions of the push-button switch to determine the function sequence.

9. The system of claim 1, wherein the single user actuated control mechanism comprises a rotatable potentiometer, and wherein at least one of the plurality of selective actuations corresponds to a positional orientation of the potentiometer.

10. The system of claim 9, wherein the potentiometer is adapted to rotate upon user rotation of the potentiometer.

11. The system of claim 9, wherein the control circuit is adapted to control an intensity of the light based on the positional orientation of the potentiometer.

12. The system of claim 9, wherein the pattern corresponds to a pattern of rotational movements of the potentiometer within the predetermined period of time.

13. The system of claim 12, wherein the control circuit is adapted to count a number of the rotational movements of the potentiometer to determine the function sequence.

14. A method of initiating a repeating visual signal with a portable lighting system, the method comprising:

receiving at a user control interface of the portable lighting system a pattern of a plurality of selective actuations by a user within a predetermined period of time and while the portable lighting system is held by the user for portable use, wherein the user control interface comprises a single user actuated control mechanism and the pattern comprises one or more switch rates;

receiving, by a control circuit of the portable lighting system, the pattern from the user control interface;

determining, by the control circuit of the system, the one or more switch rates of the pattern;

determining, by the control circuit of the system, a function sequence based, at least in part, on the one or more switch rates of the received pattern after the predetermined period of time has timed out; and operating a light source of the portable lighting system to display the repeating visual signal associated with the function sequence, wherein the light source is adapted to provide both ambient illumination and visual signals.

15. The method of claim 14, wherein the pattern corresponds to a plurality of power up cycles received within the predetermined period of time.

16. The method of claim 14, the method further comprising terminating the operating of the light source in response to the user control interface.

17. The method of claim 14, wherein the light source comprises at least one light emitting diode (LED).

18. The method of claim 14, wherein the function sequence is an SOS signal.

19. The method of claim 14, wherein the function sequence is a strobe signal.

20. The method of claim 14, wherein the system is a flashlight configured to be held for portable use by a hand of the user.

21. The method of claim 14, wherein the system is a headlamp configured to be held for portable use by a head of the user.

22. The method of claim 14, wherein the single user actuated control mechanism comprises a push-button switch, and wherein the pattern corresponds to a pattern of depressions of the push-button switch within the predetermined period of time.

23. The method of claim 22, wherein the determining the function sequence comprises counting a number of the depressions of the push-button switch to determine the function sequence.

24. The method of claim 14, wherein the single user actuated control mechanism comprises a rotatable potentiometer, and wherein at least one of the plurality of selective actuations corresponds to a positional orientation of the potentiometer.

25. The method of claim 24, wherein the potentiometer is adapted to rotate upon user rotation of the potentiometer.

26. The method of claim 24, further comprising controlling an intensity of light provided by the light source based on the positional orientation of the potentiometer.

27. The method of claim 24, wherein the pattern corresponds to a pattern of rotational movements of the potentiometer within the predetermined period of time.

28. The method of claim 27, wherein the determining the function sequence comprises counting a number of the rotational movements of the potentiometer.

29. A portable lighting system comprising:

means for emitting light adapted to provide both ambient illumination and visual signals;

means for receiving a pattern of a plurality of selective actuations by a user within a predetermined period of time and while the portable lighting system is held by the user for portable use, wherein the pattern receiving means comprises a single user actuated control mechanism and the pattern comprises one or more switch rates;

means for receiving the pattern from the single user actuated control mechanism, determining the one or more switch rates of the received pattern, and determining a function sequence based, at least in part, on the one or more switch rates of the received pattern after the predetermined period of time has timed out; and means for operating the light emitting means to display a repeating visual signal associated with the function sequence.

30. A machine-readable medium comprising a plurality of machine-readable instructions which when executed by a computing device of a portable lighting system are adapted to cause the computing device to:

receive a pattern of a plurality of selective actuations from a user control interface of the portable lighting system within a predetermined period of time and while the system is held by the user for portable use, wherein the user control interface comprises a single user actuated control mechanism and the pattern comprises one or more switch rates;

determine the one or more switch rates of the pattern;

determine a function sequence based, at least in part, on the one or more switch rates of the received pattern after the predetermined period of time has timed out; and operate a light source of the system by to display a repeating visual signal associated with the function sequence, wherein the light source is adapted to provide both ambient illumination and visual signals.

* * * * *